United States Patent [19]

Bellaff

[11] 4,295,519

[45] Oct. 20, 1981

[54] HEAT RECLAIMER

[76] Inventor: Leslie Bellaff, 416 Windsor Rd., River Edge, N.J. 07661

[21] Appl. No.: 93,873

[22] Filed: Nov. 13, 1979

[51] Int. Cl.[3] ..... F28F 19/00

[52] U.S. Cl. ..... 165/11 R; 165/39; 165/94; 165/95; 165/111; 165/119; 165/134 DP; 165/DIG. 2; 237/55; 55/269; 55/DIG. 25

[58] Field of Search ..... 165/DIG. 2, DIG. 12, 165/32, 39, 70, 94, 95, 111, 134 DP, 11, 119; 237/55; 55/269, DIG. 25, DIG. 30

[56] References Cited

U.S. PATENT DOCUMENTS

| | | | |
|---|---|---|---|
| 2,890,862 | 6/1959 | Heller | 165/95 |
| 3,048,275 | 8/1962 | Headrick | 55/DIG. 25 |
| 3,171,472 | 3/1965 | Bauer | 165/95 |
| 4,215,741 | 8/1980 | Averbuch et al. | 165/11 |

*Primary Examiner*—Albert W. Davis
*Assistant Examiner*—Margaret A. Focarino
*Attorney, Agent, or Firm*—McGlew and Tuttle

[57] ABSTRACT

A heat reclaimer for the exhaust flue of a heating unit comprising, a housing having an air input space, an air output space, and an exhaust space, with a plurality of tubes connected between and communicating the air input space with the air output space and extending through the exhaust space. The exhaust flue of the heating unit is connected into the exhaust space of the housing and an exhaust output is connected to the housing extending from the exhaust space for venting exhaust coming from the heater into the exhaust space to a chimney, for example. A float or level switch is connected to the housing near the bottom of the exhaust space for switching, for example, an alarm if water accumulates in the exhaust space from condensed water vapor in the exhaust. At least one hole is also provided in the housing above the level of the float switch to permit condensed water to leave the exhaust space. The hole is provided in case the float switch clogs with soot. A wiping device may also be provided in the exhaust space for wiping the exterior surfaces of the tubes and removing films of water and soot which might accumulate thereon and reduce their heat transfer capacity.

18 Claims, 1 Drawing Figure

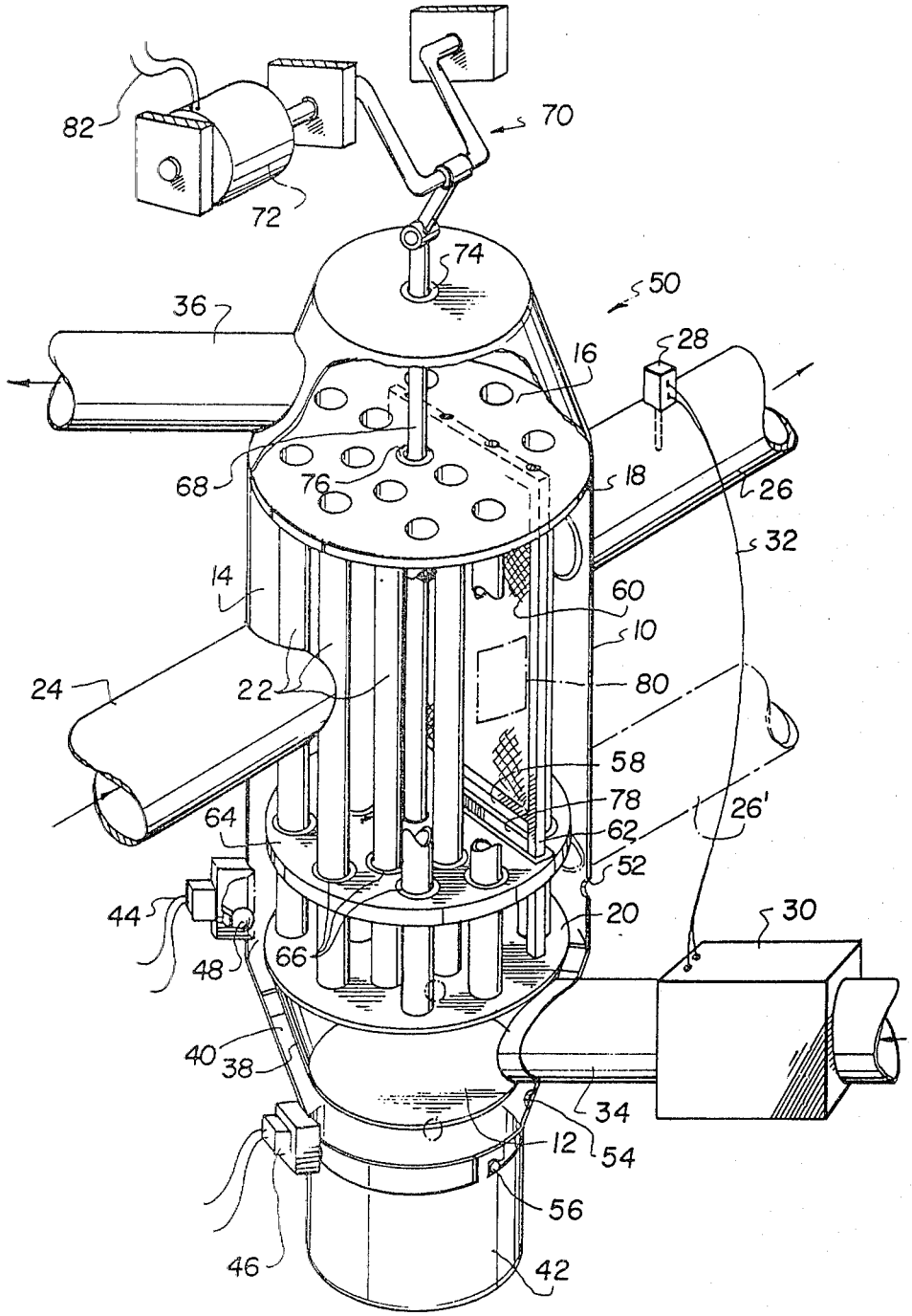
82
70
72
74
50
36
28
16
68
76
18
26
32
14
60
10
24
22
80
58
78
26'
64
62
52
44
20
30
48
66
40
38
34
12
54
56
46
42

HEAT RECLAIMER

FIELD AND BACKGROUND OF THE INVENTION

The present invention relates in general to heat reclaimers and, in particular to a new and useful heat reclaimer for extracting heat from the exhaust fumes of a heater such as a boiler or furnace.

The present invention is related to the inventions disclosed in the inventor's previous two patent applications which are incorporated here by reference. The first application entitled, Home Heating System, Ser. No. 946,188 filed Sept. 27, 1978 defines an overall system for enhancing the efficiency of heating units which may utilize a heat reclaimer such as the one disclosed in the present application. The other application entitled Balancing Air Device For a Heating Unit, Ser. No. 080,058 filed Sept. 28, 1979 defines a system for increasing the efficiency of a heating unit having a combustion chamber which system can be augmented and used in combination with the invention disclosed here.

Heat exchange devices are known for use in the exhaust flues of heaters such as furnaces and boilers. Some of these heat exchangers include tubes which are exposed to the exhaust fumes of the heater. A problem arises when the heat exchangers extract heat from the exhaust fumes to such a degree that the temperature of the fumes fluctuates through the ambient dew point. At this point some water vapor which is in the exhaust fumes condenses and may re-evaporate to form a steam blanket on the exterior of the tubes drastically reducing their heat transfer effect and also contributing to the deposit of soot thereon since the soot will adhere to the condensed fluid. This soot buildup also contributes to the possibility of a fire in the heat exchanger since, with sufficient amounts of soot deposited in the heat exchanger and at a sufficiently high temperature of the exhaust gases, the soot might be ignited. The water condensed in the heat exchanger may also cause corrosion and may even partially fill the device.

While high deposits of soot are usually the problem only in larger furnaces or boilers used for example in apartment houses and the like, smaller furnaces and boilers using heat exchange devices also experience problems connected with the condensation of vapors.

SUMMARY OF THE INVENTION

The present invention provides a heat reclaimer which utilizes tubes extending through a space in a housing supplied with exhaust fumes from a heater. In accordance with one embodiment of the invention, a commercially available coalescing filter is fitted into the exhaust space through which the tubes extend after or downstream of the first few rows of tubes in the heat reclaimer. The characteristics of this known type of filter are that while the exhaust fumes are permitted to flow freely through the filter, the material of the filter cause a cooling of the fumes below the dew point which results in the condensation of water vapor carried by the fumes. This effect is augmented by the contact of particles carried by the exhaust fumes with the filter which reduce their temperature and enhance the condensation effect. The condensed fluid is drained from the bottom of the filter and conducted along grooves in the filter material quickly before it can re-evaporate. Soot which contacts the filter tends to wash along with the condensate off the bottom of the filter and be applied to a drain or drain pail forming part of the invention. Depending on the type of fuel used and the size of the heating unit, it is advantageous to provide a glass inspection window in the housing of the heat reclaimer for a direct inspection of the exhaust space to indicate when the cleaning is required. When oil is used as a fuel for example, the production of soot is at a much higher level than when natural gas or propane are used as a fuel. Soot that is washed to drain in the heat reclaimer is not available to precipitate out in the chimney which in time, could block exhaust flow.

The housing of the heat reclaimer may also include a quick opening door which for example, may carry the inspection window for permitting the opening of the housing so that the tubes may be sprayed with a cleanser to remove the soot. The same apparatus provided for the drainage of condensed fluid can then be used to drain the cleansing fluid.

Even if the coalescing filter becomes completely clogged it will not effect safety, only the advantages it gives in efficiency when operation is below the dew point will be lost. The clogged filter will then act as a baffle for diverting the exhaust fumes and increasing the dwell time of fumes in the heat reclaimer. It is advantageous when using the coalescing filter or when the filter is clogged or, in an alternate embodiment, when using a a solid baffle, to extend the baffle approximately two-thirds of the way down the length of the tubes from the top of the exhaust space. This design while permitting free passage of the exhaust fumes also enhances the heat transfer effect.

Another form of the invention preferably used in large commercial heating installations, includes the use of a slidably mounted plate having brass wiping rings embracing each of the tubes. This embodiment of the invention can be used alone or in conjunction with the coalescing or baffle described above. The wiper plate is connected through a rod to an actuator means which, for example, smay be a motor for rotating a crank connected to the push rod or a rack and pinion arrangement. When the plate is moved upwardly and downwardly, the wiper rings ride up and down on the outer surface of the tubes and wipe them clean of soot and condensed fluid. The rate of such movement should be slow for example, at the rate of approximately one foot per fifteen seconds.

In addition to cleaning the tubes, the wiping action improves the heat transfer effect of the tubes by removing the soot and also removing a steam blanket which might form on the tubes by the condensation then revaporization of the water in the exhaust fumes. In a system having exhaust fumes which constantly change in temperature through the dew point, this revaporization becomes a problem substantially reducing the heat transfer effect of the device.

The wiper motor may be activated either manually or when the flame is on by a suitably provided switch. The wiper motor may also be activated conjointly when the flame is on and also when a temperature sensor in the exhaust output of the heat reclaimer indicates that the temperature is below the dew point.

When the heat reclaimer is used either with the coalescing filter or wiper device or both, a fan may be provided in the cool air input to the heat reclaimer for actively moving cool house air through the tubes of the heat reclaimer. The fan may be run either continuously, only when the flame is on in the heater, for the flame-on period plus a predetermined time after the flame-on period, for example, a few minutes thereafter, or in accordance with a temperature switch which activates the fan only when the temperature in the exhaust output of the heat reclaimer is above the dew point. The activation of the fan only when the exhaust is above the dew point reduces the condensation effect thus avoiding the need for the coalescing filter or the wipers. This also removes the reduction in efficiency due to the formation of a steam blanket by the re-evaporation of the condensed fluid on the tubes and conserves the electricity used for operating the fan since the heat reclaimer is used only when it can draw the maximum of heat from the exhaust fumes (which are at a temperature above the due point and relatively high).

When the fan is used for extracting heat from the exhaust fumes below the dew point temperature, the coalescing filter and/or wiping apparatus may be used. A safety feature which preferably is then also used in the heat reclaimer is a float or level switch positioned near the base of the exhaust space for activation if and when fluid from the condensed water vapor rises to the level of the float switch. In the extreme, if such levels are permitted to rise, they may block off the flow of exhaust fumes and produce a potentially dangerous condition which may include a weight problem. The float switch may be either connected to an alarm or connected to the fan to stop the operation of the fan to permit the evaporization of this water. Four $\frac{1}{8}$ inch in diameter holes are also provided above the level of the float switch to permit the drainage of excess water in the exhaust space. If the float switch fails, these drainage holes then permit the outflow of water from the exhaust space and act as an additional safety feature.

The housing for the heat reclaimer may also be provided with a drain or drain pail near the bottom thereof below the exhaust space. A passage is also provided between the exhaust space and the drain or drain pail to permit the flow of water directly to a drain or to the drain pail. A second float switch may be provided near the top of the drain pail to indicate when it is full and must be emptied. This emptying may be done manually by disconnecting the drain pail from the rest of the heat reclaimer housing. Both float switches may also be maintained in case the drain passage clogs with soot.

The heat reclaimer may also be provided with water to heat the water rather than with air to augment a water heater by preheating water supplied thereto.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

BRIEF DESCRIPTION OF THE DRAWINGS

The only FIGURE in the case is a top perspective view of the invention with portions cut away for clarity.

DESCRIPTION OF THE PREFERRED EMBODIMENTS

Turning to the FIGURE, in particular, the invention embodied therein comprises a heat reclaimer generally designated 50 having a housing 10 defining a cool air input space 12, and exhaust space 14 and a cool air output space 16. Exhaust space 14 is defined between top and bottom tube plates 18 and 20 respectively. The air input and output space 12 and 16 are communicated with each other by a purality of tubes 22 extending therebetween and in the exhaust space 14. Exhaust fumes or gas is provided to the exhaust space 14 through a furnace exhaust flue 24 and vented from the exhaust space 14 through an exhaust output or heat reclaimer exhaust flue 26. Exhaust output 26 is provided with a temperature switch 28 which is connected to various other elements in the system for example, to a blower or fan shown at box 30 by wires 32. Temperature switch 28 is set for example, to activate blower 30 when the temperature of exhaust fumes moving through exhaust output 26 rises above an ambient dew point.

While the condensation of water vapor in heat reclaimer is anticipated in some embodiments of the invention and dealt with, the exhaust output 26 may be provided without an insulated outer covering since most of the heat is extracted from the exhaust fumes in the exhaust space 14 and most condensation takes place in this space and not in the output 26.

Cool air from the building serviced by the heater attached to the furnace or heater exhaust flue 24 is provided through a cool air input 34 and, in some embodiments of the invention, forced into the cool air input space 12 by the blower or fan 30. The air then travels upwardly through tubes 24 and into space 16 then out of the heat reclaimer in the form of warm output air through air output 36.

Lower air input space 12 includes a bordering wall 36 which separates space 12 from the outer housing 10. A drain passage 40 is thus defined between the outer housing 10 and the boundary wall 38 to permit the downward flow of condensate and soot from the exhaust space 14 into a drain reservoir or pail 42 or into a suitably provided drain replacing the pail 42. It should be understood that while an annular and frusto-conical passage 40 is shown in the FIGURE, this passage may be replaced by a simple tube or the like connecting space 14 with pail 42 so that the air space 12 is defined by the walls of the housing 10.

First and second float switches 44 and 46 respectively are connected to the housing 10 at space locations thereon. Each float includes a ball 48 which, activates the respective switch if a water level rises above the float ball. The switches 44 and 46 may advantageously be connected in series with the fan 30 to deactivate the fan 30 when a water level rises above the level of either of the switches. The two switches are provided as a redundancy in case one switch fails to disengage the fan 30. By disengaging the fan 30 the water in housing 10 is permitted to vaporize since the temperature in the heat reclaimer rises to prevent water from rising to the level of the exhaust flue 24. Small holes which may be for example, $\frac{1}{4}$ or $\frac{1}{8}$ of an inch are provided through the housing at 52 which act as a further backup to drain water from the housing 10 if both switches fail to operate. A lower set of holes 54 may also be provided as a backup to the top set of holes 52.

As shown in the drawing, the drain pail 42 may be disengaged from the housing 10 by the use of two or more bayonet connections 56.

The top of first float switch 44 is advantageously provided approximately three inches below the bottom edge 58 of a coalescing filter 60. The float switch 44 is also provided in the vicinity of the bottom of space 14. While the fan 30 is shown between the levels of float 44 and 46, it is also advantageous to provide the fan at a higher level than either of the switches to prevent a damaging of the fan due to a rising water level, and a leak.

In accordance with one feature of the invention, coalescing filter 60 is provided in the exhaust space 14 behind a few rows of tubes 22. Coalescing filter permits more complete transfer of heat and through-flow of exhaust fumes while enhancing the condensation of water vapors in the fumes which fall to the bottom of space 14. This also washes soot from the coalescing filter 60. The filter 60 extends approximately ⅔ of the way down space 14 and includes frame posts 62 connected to the bottom plate 20 and a top frame portion connected to the top plate 18. In another embodiment of the invention, filter 60 is replaced by a solid baffle which only deflects the flow of exhaust coming from flue 24 and exiting through flue 26.

In an alternate embodiment of the invention, a wiper plate 64 is provided with a plurality of wiper rings 66 each engaged closely around a respective tube 22. Wiper plate 64 is connected to a push rod 68 which in turn is connected to a crank and motor arrangement generally designated 70. A motor 72 is operated to turn the crank and move the rod 60 upwardly and downwardly at a slow rate of speed to wipe the outer surface of tubes 22 of condensed fluid and soot which may have accumulated thereon. The soot and fluid is then washed down the passage 40 and into the drain pail 42. While the housing 10 of the heat reclaimer may be made of any suitable material such as stainless steel, or the like, soft metal fields 74 and 76 are provided for guiding the movement of rod 68. The wiper means comprising the wiper plate 64 and the drive means 70 may be used in conjunction with a coalescing filter or baffle 60 in which case a suitably provided slot 78 is necessary for the passage of the filter or baffle. Frame edges 62 extend the entire length of exhaust space 14 so as to guide the wiper plate 64 especially when it is in its lowermost position. An inspection window 80 is provided for inspecting the interior of the heat exchanger for soot deposits which may also be in the form of a quick access door to permit direct access to the exhaust space 14 for cleaning. The door may be hinged to the housing and latched to hold the door closed.

As shown in the drawing, the wiper plate 64 is of a diameter smaller than the diameter of the space 14 so that any soot and water accumulations on the top of the wiper plate can move around the sides of the wiper plate and fall to the bottom of the housing. This space also permits a flow of exhaust fumes around the wiper plate in case the wiper plate becomes stuck at some lowered position in the housing. This acts as a safety feature to prevent blockage of the exhaust flow. In an alternate form of the invention, the wiper rings 66 can be adapted for wiping soot and condensate from the tubes 22 only when plate 64 is moved downwardly.

In an embodiment of the invention having the wiper means only and no coalescing filter or baffle 60, the exhaust output 26 is replaced by a lower exhaust output 26' shown in dot/dash line. This is utilized so that sufficient circulation of the exhaust fumes is permitted in the exhaust space 14 to increase the heat transfer effect. With the use of a baffle or filter 60, the exhaust flue 26 is at the same level as the furnace flue 24 since in these embodiments the exhaust fumes are at least partially conducted around the baffle or filter 60.

The wiper drive assembly 70 may be replaced for example, by a rack and pinion or any other actuating means for raising or lowering the rod 68.

In operation, the motor 72 is connected through its lines 82 to the furnace or heater so that the wiper plate 24 is moved only when the furnace is on. Alternatively, the motor 72 can be connected to the temperature switch 28 by lines not shown so that another criterion for moving the wiper plate 64 is that the temperature in flue 26 falls below the dew point which would indicate the presence of condensing fluid in the heat reclaimer.

While air is shown as a heat transfer medium, water can replace this medium to provide preheating for a hot water system. The water thus would be provided through inlets 34 up through tubes 22 and out through outlet 36.

When the heat transfer medium is water, the element 30 can be a pump which is controlled in the same manner that the blower 30 was controlled. Thus temperature switch 28 can be connected to pump 30 to activate it only when the exhaust in the exhaust flue 26 is at a temperature above an ambient dew point temperature. Further, a connection can be made between the boiler or heating unit and the pump 30 to activate the pump 30 only when the heating unit is activated or only for a short period after the heating unit has been reactivated. Sensor means in the form of another temperature switch can also be provided, for example, in the outlet 36 for controlling the pump 30 if for example, steam develops in the water supplied by the pump 30 due to an overly high temperature and heat transfer within space 14.

The positioning of coalescing filter 60 behind or downstream of a few rows of tubes 22 permits the cooling of exhaust fumes by these few rows before the fumes strike the coalescing filter and to reduce the possibility of a fire caused by excessive heat in the heat reclaimer and excessive amounts of soot on the coalescing filter.

By inducing condensation in the exhaust space 14, the fumes leaving through outlet flue 26 are extremely clean and substantially reduced in density or weight. Even a very low temperature differential between the exhaust fumes and outside air therefore permits a rising of the fumes so that a tall chimney may be eliminated entirely. Thus even a very small temperature differential between the exhaust fumes and the outside ambient air would permit a draft to be produced so that the fumes may be expelled from a duct which is only slightly higher than the combustion chamber and heat exchanger exhaust.

While specific embodiments of the invention have been shown and described in detail to illustrate the application of the principles of the invention, it will be understood that the invention may be embodied otherwise without departing from such principles.

What is claimed is:

1. A heat reclaimer for the exhaust flue of a heating unit comprising; a housing having an air input space, an air output space and an exhaust space; tube means connected between and communicating said air input and output spaces, extending through said exhaust space; the exhaust flue of the heating unit connected to said housing and into said exhaust space; an exhaust output connected to said housing and into said exhaust space for venting exhaust coming from the heating unit through the exhaust flue, out of said exhaust space; and a level switch connected to said housing at a location spaced from the top of said exhaust space activated if water accumulates in said exhaust space from condensed water vapor in the exhaust; said housing having at least one hole therethrough communicating with said exhaust space in the vicinity of the level of said level switch for draining water in said exhaust space rising to the level of said hole.

2. A heat reclaimer according to claim 1 further including wiper means engaged around said tube means and drive means connected to said wiper means for moving said wiper means along said tube means to wipe any condensed water or soot deposited on said tube means.

3. A heat reclaimer according to claim 2 wherein said tube means comprises a plurality of separate tubes, said wiper means comprises a wiper plate having a wiper ring positioned around and in close contact with each of said tubes.

4. A heat reclaimer according to claim 3 wherein said drive means comprises a rod connected to said wiper plate and extending out of said housing, a crank connected to said rod and a motor connected to said crank for rotating said crank and moving said rod upwardly and downwardly to displace said wiper plate in said housing.

5. A heat reclaimer according to claim 1 further including a lower drain means connected to the bottom of said housing, a passage communicating said exhaust space with said lower drain means, a second level switch connected adjacent the top of said lower drain means activated when a level of water in said lower drain means rises to the level of said second level switch.

6. A heat reclaimer according to claim 5 wherein said drain means comprises a drain pail removably mounted to the bottom of said housing.

7. A heat reclaimer according to claim 1 further including a coalescing filter extending partially across a cross-sectional flow area of said exhaust space and across a flow path of exhaust therein for inducing the condensation of water vapor in the exhaust in the exhaust space.

8. A heat reclaimer according to claim 7 wherein said tube means comprises a plurality of separate tubes in a plurality of rows, said coalescing filter being disposed in said exhaust space downstream of at least some of said rows of tubes.

9. A heat reclaimer according to claim 1 further including a baffle extending across at least a part of a flow area of said exhaust space and in a path of exhaust in said exhaust space.

10. A heat reclaimer according to claim 1 further including an air inlet duct connected to said air input space and a fan in said duct for moving air into said input space.

11. A heat reclaimer according to claim 10 further including a temperature switch in said exhaust flue, said fan connected to said temperature switch for the activation of said fan only when exhaust in said exhaust flue are at a temperature above an ambient dew point.

12. A heat reclaimer according to claim 10 wherein said fan is connected to the heating unit for activation only when the heating unit is activated to produce exhaust.

13. A heat reclaimer according to claim 12 wherein said fan is maintained on for a relatively short time after the heating unit is deactivated.

14. A heat reclaimer for the exhaust flue of a heating unit comprising; a housing having a water input space, a water output space and an exhaust space; tube means connected between and communicating said input and output spaces, extending through said exhaust space; the exhaust flue of the heating unit connected to said housing and into said exhaust space; an exhaust output connected to said housing and into said exhaust space for venting exhaust coming from the heating unit through the exhaust flue, out of said exhaust space; and a level switch connected to said housing at a location spaced from the top of said exhaust space activated if water accumulates in said exhaust space from condensed water vapor in the exhaust; said housing have at least one hole therethrough communicating with said exhaust space in the vicinity of the level of said level switch for draining water in said exhaust space rising to the level of said hole, means for circulating water from said input space to said output space and control means connected to said means for circulating water to prevent the formation of steam in the water supplied by said circulating means.

15. A heat reclaimer according to claim 14 wherein said control means comprises a temperature switch in said exhaust flue, said means for circulating water connected to said exhaust switch for the activation of said means for circulating water only when exhaust in said exhaust flue are at a temperature above an ambient dew point.

16. A heat reclaimer according to claim 14 wherein said means for circulating water is activated only when the heating unit is activated to produce exhaust.

17. A heat reclaimer according to claim 16 wherein said means for circulating water is activated for a short time after the heating unit is deactivated.

18. A heat reclaimer according to claim 11, wherein said level switch is connected to said fan for deactivation of said fan when said level switch is activated.

* * * * *